US007469852B2

(12) United States Patent
Sharp

(10) Patent No.: US 7,469,852 B2
(45) Date of Patent: Dec. 30, 2008

(54) LOAD TRANSFERENCE IN GRINDING DISKS

(75) Inventor: Rodney Warwick Sharp, Hamilton (NZ)

(73) Assignee: Progressive IP Limited, Hamilton (NZ)

( * ) Notice: Subject to any disclaimer, the term of this patent is extended or adjusted under 35 U.S.C. 154(b) by 239 days.

(21) Appl. No.: 11/092,557

(22) Filed: Mar. 29, 2005

(65) Prior Publication Data

US 2005/0263624 A1 Dec. 1, 2005

(30) Foreign Application Priority Data

Mar. 29, 2004 (NZ) ..... 532007

(51) Int. Cl.
*B02C 1/08* (2006.01)
*B02C 7/04* (2006.01)
*B02C 13/20* (2006.01)

(52) U.S. Cl. ..... 241/236; 241/294

(58) Field of Classification Search ..... 241/294, 241/236

See application file for complete search history.

(56) References Cited

U.S. PATENT DOCUMENTS 4,569,380 A * 2/1986 Arasmith ..... 144/172
4,826,090 A * 5/1989 Orphall ..... 241/191
5,240,192 A * 8/1993 Tilby et al. ..... 241/292.1
5,730,375 A * 3/1998 Cranfill et al. ..... 241/243
5,957,176 A * 9/1999 Stein ..... 144/230
6,343,755 B1 * 2/2002 Barclay et al. ..... 241/236
6,364,227 B1 * 4/2002 Dorscht ..... 241/197
2004/0000606 A1 * 1/2004 Diemunsch ..... 241/236

* cited by examiner

*Primary Examiner*—Bena Miller
(74) *Attorney, Agent, or Firm*—Young & Thompson

(57) ABSTRACT

The present invention relates to a disk section (1) for use in the construction of a grinding disk (10) such as may be used in wood hogging, chipping, or grinding apparatus. The disk section (1) is associated with a substantially wedge shaped retaining segment (30) which is positioned near the circumference of the assembled grinding disk(10), and preferentially overlaps at least part of two adjacent disk sections (1) thereon. The arrangement is such that tangential type impacts acting on a disk section (1) results in at least partial energy transmission to the retaining segment (30) and its connection (38, 39) to a hub (9).

20 Claims, 3 Drawing Sheets

LOAD TRANSFERENCE IN GRINDING DISKS

FIELD OF INVENTION

The present invention is directed to methods of transferring loads encountered by localized resistance to rotation in disk assemblies. In particular such disk assemblies are commonly used in grinding, chipping, breaking, and crushing operations, and including in devices such as wood hoggers.

BACKGROUND DESCRIPTION

The present invention takes into account problems associated with grinding disks and such like in equipment such as wood hoggers. However, many such devices are being used to break down a variety of different materials including soft and hard rocks, recycled asphalt and roading, demolition masonry, and tires etc. The problems encountered when acting on these different materials are largely similar, though some of the problems may be more prevalent when acting on different types of material. For simplicity of description, problems associated with wood hoggers comminuting wood materials will be referred to for the main part, though the teachings are applicable to related applications, such as (for instance) described above.

Typical disks (and we shall also include drums by inference as these are essentially a disk of greater thickness) used in wood hoggers and the like are generally made up of separate components, rather than being a single unitary component. Typically the disk is made up of a central hub portion and a plurality of disk sections radially distributed about this hub. Each of these disk sections, which generally resemble a sector in appearance (apart from a removed inner portion corresponding to the position of the hub) are generally fixed directly to the hub itself. In a log hogger, teeth are generally provided on either or both of the planar surfaces of the disk, and its circumferential edge.

A problem often arises when sudden resistance to rotation of the disk is encountered. Such resistance often occurs locally (i.e. centralized on a single disk section) and often has the effect and consequences of an impact. The cause of such 'impact' is typically the entry of foreign materials such metal and rocks into the system rather than the substantially softer wood which is being processed. Such impacts place an exceptionally high strain on the bolts, generally positioned on the inner end of the segments and connecting them to the hub. This can, in exceptional circumstances, lead to catastrophic failure of those bolts with potentially disastrous results for the disk assembly and associated equipment.

Fortunately, in well maintained equipment this is not common, though frequent maintenance is generally required, and the system is nevertheless occasionally exposed to significant stresses from such sharp impacts.

As wood hoggers are more commonly being used for breaking harder materials, including rocks and demolition materials, the impact and forces acting on teeth and disk segments increase significantly. The likelihood of catastrophic failure is increased, and the need for regular preventative maintenance becomes even more pronounced. Hence, what represented a problem for disks acting on wood, becomes a major problem for disks acting on harder materials.

Another problem which is often prevalent in grinding disks is the misalignment of disk sections, generally contributed to by repeated impacts. Ideally the sections should be positioned and retained such that the outer arcuate edges form substantially a perfect circle. However, over time, and as a consequence of impact, the arcuate outer edges of the sections can become misaligned, with steps resulting between adjacent sections. In current designs there is no easy fine adjustment to allow for quick realignment of the disk sections, and fixing the problem may require machining of the connections with the hub.

It is an object of the present invention to consider these problems and to provide the public with a useful choice.

It is also an object of the present invention to provide a system for the construction or connection of the disk assembly which addresses the stresses placed on individual disk sections as a consequence of localized impact and forces resulting from use.

It is also an object of the present invention to be able to provide a method of assembling a disk assembly wherein such localized impact enforces can be at least partially absorbed by a readily replaceable and potentially expendable element.

Aspects of the present invention will be described by way of example only and with reference to the ensuing description.

GENERAL DESCRIPTION OF THE INVENTION

According to one aspect of the present invention there is provided a disk section for use in a disk assembly, said disk section either or both bearing grinding teeth, or allowing for the attachment of same;

there being provided a first face for bearing against a supporting hub;

there being second and third faces extending from the first face, to a fourth outer face;

there being positioned at the intersection of either or both the second with fourth, or third with fourth faces, a tapered removed portion accommodating part of a retaining segment connectable to said hub.

According to another aspect of the present invention there is provided a disk section, substantially as described above, in which the angle of taper of the tapered removed portion, relative to a radial line extending from the centre of the hub is substantially the same as the angle of the contacting face of the retaining segment relative to its centerline when viewed from the front.

According to another aspect of the present invention there is provided a disk section, substantially as described above, in which the tapered removed portion accommodates approximately half the retaining segment.

According to another aspect of the present invention there is provided a disk section, substantially as described above, in which the exposed face of the tapered removed portion is substantially planar.

According to another aspect of the present invention there is provided a disk section, substantially as described above, in which the exposed face of the tapered removed portion is curved or non-planar.

According to another aspect of the present invention there is provided a disk section, substantially as described above, in which a second or third face associated with a tapered removed portion includes additional removed portions to accommodate connection means for said retaining segment to the hub.

According to another aspect of the present invention there is provided a disk section, substantially as described above, which includes a grinding tooth, wherein said grinding tooth includes a tip comprising materials selected from the group: toughened steel, and tungsten carbide.

According to another aspect of the present invention there is provided a disk section, substantially as described above, which includes a grinding tooth, wherein said grinding tooth includes a tip comprising materials selected from the group: diamond, boron nitride, and ceramic materials.

According to another aspect of the present invention there is provided a disk section, substantially as described above, which includes an aperture for accommodating the body of a grinding tooth in turn comprising a tooth assembly comprising a tooth portion and a body.

According to another aspect of the present invention there is provided a disk section, substantially as described above, in which said tooth assembly includes provision for its fastening to the disk section.

According to another aspect of the present invention there is provided a disk section, substantially as described above, in which an aperture is positioned to support a grinding tooth to extend from the fourth said face of the disk section.

According to another aspect of the present invention there is provided a disk section, substantially as described above, in which an aperture is positioned to support a grinding tooth to extend from either or both a fifth or sixth, front and rear, face of the disk section.

According to another aspect of the present invention there is provided a disk section, substantially as described above, in which the bottom first face of the disk section is slotted to accommodate a circumferential flange of the hub.

According to another aspect of the present invention there is provided a disk section, substantially as described above, in which there is provided additional securing means for fastening the disk section to the hub.

According to another aspect of the present invention there is provided a disk section, substantially as described above, in which the additional securing means comprises bolts which connect the disk section to the circumferential flange.

According to another aspect of the present invention there is provided a disk section, substantially as described above, such that the tapered removed portion of said disk section, in combination with the tapered removed portion in a side by side adjacent second disk section, creates a combined shape and volume defined by the tapered removed portions approximate the shape of and accommodate a said retaining segment.

According to another aspect of the present invention there is provided a disk section, substantially as described above, in which there is a tapered removed portion at both the intersection of the second with fourth, and third with fourth, faces, and in which when two identical disks placed side by side adjacently such that the second face of one is face to face adjacent with the third face of the other, the shape and volume defined by the tapered removed portions associated with those faces approximate and accommodate a said retaining segment.

According to another aspect of the present invention there is provided a disk section, substantially as described above, in which the volume generally defined by the combination of tapered removed portions in contacting faces of adjacent disk sections is generally wedge shaped.

According to another aspect of the present invention there is provided a disk section, substantially as described above, in which the tapered removed sections do not extend fully to the fifth and sixth, front and rear, faces of the disk section.

According to another aspect of the present invention there is provided a disk section, substantially as described above, in which the interaction between a retaining segment and the tapered removed portion of a disk section is such that moving the retaining segment in a radial direction closer to the hub exerts a force with a perpendicular, relative to a radial line from the hub, component against said disk section when its first face bears against said hub.

According to a further aspect of the present invention there is provided a retaining segment for use with a disk section, substantially as described above, said retaining segment being either or both substantially tapered trapezoidal, or triangular, when viewed from its front; said segment including provision for a connection element passing from said segment to the hub.

According to another aspect of the present invention there is provided a retaining segment, substantially as described above, in which the connection element connects directly to the hub.

According to another aspect of the present invention there is provided a retaining segment, substantially as described above, in which there is a plurality of connection elements.

According to another aspect of the present invention there is provided a retaining segment, substantially as described above, in which a said connection element comprises a bolt which passes through the retaining segment, and extends and connects to a removable insert positionable in the hub; the head of said bolt being exposed in relation to the retaining segment to allow its adjustment, and wherein the adjustment is such as to release or draw the retaining segment towards the hub.

According to another aspect of the present invention there is provided a retaining segment, substantially as described above, in which the removable insert is substantially cylindrical.

According to another aspect of the present invention there is provided a retaining segment, substantially as described above, in which the removable insert is configured such that it may only be inserted into the hub in the correct orientation.

According to a further aspect of the present invention there is provided a disk assembly comprising a hub, and a plurality of disk sections, substantially as described above, positioned side by side adjacently thereabout;

the disk sections being maintained in position by retaining segments acting on adjacent disk sections, and which retaining segments are connected to the hub or a component associated with the hub;

a said retaining segment being substantially tapered trapezoidal in appearance and bearing against tapered removed portions associated with the disk sections, the relationship being further characterized in that tightening the connection between a retaining segment and the hub, or a component associated therewith, exerts a force on the associated disk sections having both radially directed and perpendicular, relative to the radial, components.

According to a further aspect of the present invention there is provided a disk assembly comprising a hub bearing a circumferential flange;

there being located about the hub and located over the flange a plurality of adjacent disk sections, each being substantially segment shaped in front elevation but with a removed bottom portion corresponding to the position occupied by the hub;

each disk section possessing at the intersection of its outermost face and faces contacting adjacent disk sections, a tapered removed portion which, collectively between two adjacent disk sections, defines substantially a wedge shape;

there being provided retaining segments insertable into the wedge shape defined by adjacent tapered removed portions, and which retaining segments are connected by connection elements to the hub or a part associated therewith;

said connection elements forming an adjustable connection which allows the retaining segments to be drawn towards the hub, the resulting interaction on their associated disk sections being to help secure the disk sections to the hub, the connection elements also providing for removal of the retaining segments, and consequentially disk sections, for replacement.

According to a further aspect of the present invention there is provided a method of retaining disk sections in a rotatable disk assembly such that the resulting energy from local resistance to rotation applied to a single disk section is absorbed at least partially by a retaining segment and/or its associated fastening connection.

According to another aspect of the present invention there is provided a method, substantially as described above, wherein the energy from local resistance to rotation applied to a single disk section is also transmitted at least partially at least an adjacent disk, and its associated retaining segments.

According to a further aspect of the present invention there is provided a method of retaining disk sections in a rotatable disk assembly such that the resulting energy from local resistance to rotation applied to a single disk section is absorbed at least partially by a retaining segment and/or its associated fastening connection, wherein the disk section is a disk section substantially as described above, and is retained by a said retaining segment connected to the hub.

The following terms will be defined for use in the present specification. The term 'disk', unless otherwise specified, represents a substantially cylindrical element which may be thick or thin. Hence a drum, which is a thick cylinder, shall be considered to fall within the term 'disk'. A disk shall also relate to a substantially unitary device, or an assembly of multiple portions. It is also envisaged that the present invention may be used in assemblies where several disks are placed side by side and coaxially. For simplicity, we shall refer to a disk in the singular sense.

For the purposes of this specification 'grinding disk' will refer to any disk (as defined above) used in any type of comminuting, chipping, grinding, breaking, or crushing process—i.e. any process which reduces an item into smaller pieces.

There are a number of different aspects of the present invention. In the broadest form there is provided a disk assembly which is made up of a number of particular components and which confer some potentially realizable advantages over the currently utilized systems. In particular these components comprise a disk section which is modified to work in conjunction with a retaining segment. Each of these will be described separately in the following description.

Preferred embodiments of disk sections according to the present invention generally resemble a sector of a circle in front view. Generally the inner (lower) portion is removed so the section may be used in conjunction with a hub, though this is similar to many existing arrangements. The curves of the sector may be flattened so that the individual disk section resembles a polygon, and in particular a trapezoid—collectively the assembled sections positioned about a hub approximating a circle in front view.

For clarity the disk section will be described as having a first bottom face, which is the face normally contacting the hub when connected. Extending from the first face are second and third side faces respectively. These preferably follow outward radial lines from the centre of the hub when connected. These meet up with the fourth, outer face. Additionally there are fifth and sixth, front and rear, faces respectively.

Where a disk section according to the present invention differs is in the provision of at least one removed portion at or adjacent at least one top outermost corner of the disk section—i.e. at or near the intersection of either or both the second with third, and second with fourth faces. Ideally a disk section will have two such removed corner portions. The removed portions may extend along the whole intersecting edge of the second with fourth, or third with fourth faces so that they extend into the front and rear faces. However the preference is for the removed portions not to extend into the front and rear faces, with the resulting front and rear lips acting as locating (and retaining) means for retaining segments.

These removed portions are to accommodate retaining segments according to the present invention. However it is also envisaged that modified retaining segments of the present invention may not necessarily be used at every boundary of each pair of adjacent disk sections (though this is the preference) and may be used more sparingly about the circumference of the disk assembly. For simplicity however it shall be assumed that retaining segments will be used between each adjacent pair of disk sections.

Each removed corner portion is configured such that it is complemented by the engaging edges of the associated retaining segment. However, there are some specific requirements if a desired object of the present invention is to be realized.

For the purpose of this description we shall use as a reference point a radial plane extending outwardly from the centre of the disk, and perpendicular to the plane of the disk. We will further define such a plane as representing the side face (i.e. the second and third faces) of the disk section which will be referred to in the following portion of the description.

Hence, this radial plane represents the preferred side edges and boundary between the two circumferentially positioned, edge to edge adjacent disk sections. A requirement for the best operation of the present invention is that a tangentially transmitted force—i.e. one disk section attempting to rotate about the central hub or move in a tangential approximation thereto—will act upon the retaining segment positioned at the boundary of the disk sections. This action should be in a manner which attempts to move the retaining segment further from the centre of the disk assembly. Hence, sideways movement of a disk section will attempt to move the associated retaining segment away from the centre of the disk assembly.

The purpose of this ideal arrangement reflects the type of impacts to which a disk section is normally subjected during use of a grinding disk. The impact is usually on teeth supported by the disk section, with resultant force and energy being transmitted thereto. As the rotating disk has momentum, in a simplified explanation the impacting force tends to act on the disk section to cause it to move sideways about the hub. This in turn acts on securing elements securing the disk section to the hub, and can be transmitted directly to adjacent disk sections and their securing elements. The result can be catastrophic damage to those securing elements, the hub itself (where it accommodates those securing elements), the disk section, as well as adjacent disk sections and their securing elements etc. to which the shock is transmitted.

The provision of a retaining element acting in the aforesaid manner provides a vehicle for energy dispersion other than to key or critical components in the disk assembly. Here the attempt to move the retaining segments outwardly transmits energy to the connection elements connecting the retaining segments to the hub. These can be designed to be sacrificial, and their connection to the hub may be more robust (e.g. to a stronger part of the hub). In practice it may also be found that severe impacts may serve to slightly dislocate a disk section and adjacent sections—the retaining segment design can provide for this, as well as allowing the sections to be quickly adjusted and realigned. Again this is a form of energy absorption other than catastrophic failure of key components.

This arrangement, whereby attempted tangential or sideways movement of a disk section imparts a radially outward movement component to the retaining segment, need not apply in both directions—most grinding disks are used in equipment in which they can rotate in one direction only. For instance, the right hand disk section (when the disk assembly is viewed from the front) when attempting to move left towards the left hand adjacent disk assembly, may cause the retaining segment to attempt to move further away from the centre of the disk assembly. However the corresponding movement of the left hand disk assembly towards the right hand disk assembly need not necessarily provide the same effect. Nevertheless, the preference of the present invention is for the same effect to be observed in both directions. There are a number of potentially realizable associated advantages with such an arrangement, such as self aligning and centering functions for the disk sections, which will be described later.

To achieve this effect of outward movement of the retaining segment, it is desirable that the contacting walls of the retaining segment which interact with the walls of removed portions of the associated disk sections (which accommodate the retaining segment), are not parallel to the radial reference plane. Ideally these should be curved, tapered, inclined, or otherwise featured such that the complementary width of the retaining segment at the bottom (i.e. the face closest to the centre of the disk assembly) is narrower than its topmost face. Ideally also, the contouring should be such that attempting to squeeze two adjacent disk sections together (if this were possible, though in practice there may be a slight gap introduced between adjacent disk sections in a disk assembly) had the effect of gently squeezing the retaining segment outwardly away from the centre of the disk assembly. Accordingly, contours which lock or hold the retaining segment in place (with respect to outwardly radial movement) should be avoided.

In practice the retaining segments will be attached to a suitable mounting point on the disk assembly. Preferably this mounting point is within the hub of the disk assembly, and ideally a robust point. It is preferable that this is not the weaker circumferential flange, which the disk sections fit over, of some preferred embodiments. Instead the preference is for long bolts which pass from the retaining segment through to a suitable mounting point, or retaining pin (etc) in the main body of the hub. Ideally these are high tensile bolts as they have to absorb some of the energy imparted by impact on disk sections. They may also connect to resilient elements in the hub, or utilize resilient packers or washers. While resilient, these elements or features should be firm. Materials envisaged are nylons and plastics polymers of the type commonly used in vehicle suspensions as bushes and such like.

Accordingly, these long bolts, whose passage through the disk sections are accommodated by suitably removed portions in the disk sections and hub, retain the retaining segments, and consequently the individual disk sections in place. Additionally, if the left and right contacting faces of the retaining segment (when viewed from the front) are relatively symmetrical with respect to the radial reference plane, then tightening of the bolts will have an equivalent and self aligning effect on adjacent disk sections. This can provide some advantage in rapidly assembling and maintaining a disk assembly in a manner such that one achieves a substantially a true circle about its circumference.

In preferred embodiments some additional connection elements may be provided between a disk section and hub, ideally positioned near the bottom (first) face of the disk section, and ideally passing through overlapping portions of disk section and hub when a circumferential hub flange is present. These connections need not be overly strong or secure and may even permit a small degree of movement (within a plane substantially perpendicular to the rotational axis of the hub) between the disk section and hub. Normally this movement would be restrained by the retaining segments and their connection elements to the hub. This small degree of permitted movement can facilitate and determine the degree of energy transmission to a retaining segment and its associated connection elements, etc.

While adjacent disk sections may be assembled (in the final disk assembly) such that their closest edges are in hard abutment to each other, there may be some advantage in providing the small gap between each section, thereby also providing for permitted movement such as described in the previous paragraph. By maintaining such a small gap then transmitted rotational or tangential force on one section towards another will more likely to transmit energy to the retaining segment rather than directly to the adjacent section. If necessary resilient packers or spacers, with the option of these comprising energy absorbing materials, may be provided between each disk section, or may be even formed in or provided on the edges of the disk sections.

It should be appreciated that for a connecting fastening element (such as a bolt) extending from such a retaining segment to the hub, a tensile force will be applied to that retaining element should the retaining segment attempt to be moved outwards in response to a sideways movement a disk section—such as resulting from an impact. As shall be seen below, this resultant tensile force will be responsible for absorbing at least part of the energy from localized impact (i.e. sudden and significant resistances to rotation of a disk section in the disk assembly). Furthermore, the fastening/retaining element securing the retaining segment to the hub can be considered as an expendable and/or replaceable item. In effect, this element will be sacrificed ahead of the disk section, and will absorb much of the energy imparted to the disk section during undesirable impact, rather in the previous case where all such impacts were absorbed by the disk section, its connecting bolts (where the energy did not result in a tensile force on the bolts) or its teeth alone.

In preferred embodiments it is considered that each disk section is likely to also possess teeth so as to effect a grinding, chipping, or other type of action on materials to be processed. For simplicity teeth have largely been omitted from the description thus far. These teeth may be integrally formed in the disk section, though preferred embodiments employ replaceable tooth elements. Some of these will be more clearly seen in the attached drawings.

It is also considered that in severe cases of obstruction, individual teeth will likely break off, reducing the maximum load and impact which can be exerted in a localized manner on a single disk section. This can be taken into account in the specific design of a disk assembly according to the present invention.

DESCRIPTION OF PREFERRED EMBODIMENT

Figure 1:
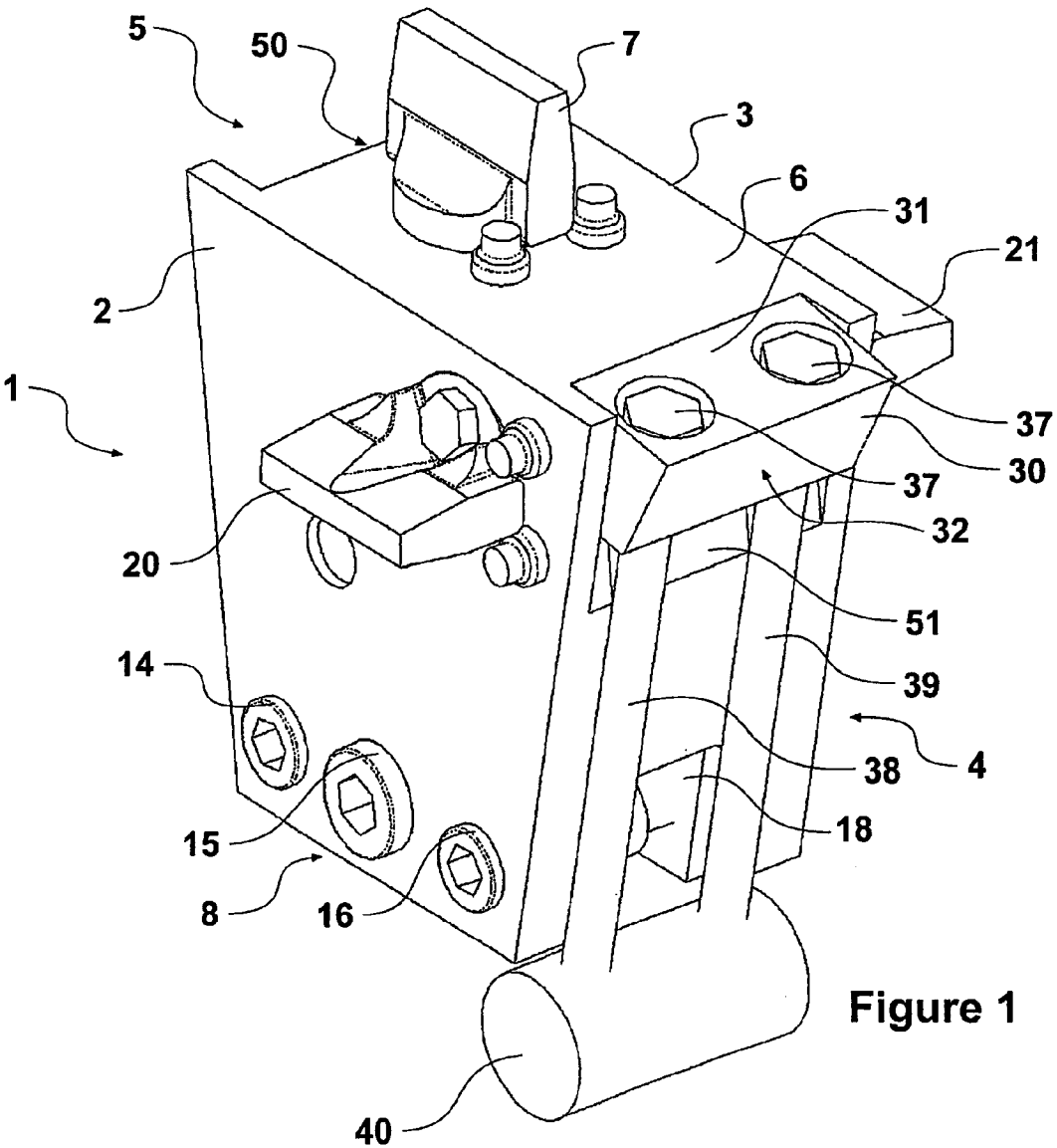
FIG. 1 is a perspective diagrammatic view of a disk section and retaining segment according to a preferred embodiment of the present invention.

With reference to the drawings and by way of example only, there is shown in FIG. 1 a disk section, generally indicated by arrow 1. This has a front face (2), rear face (3), and end faces indicated by arrows 4 and 5. The top face is indicated by arrow 6 and includes a removable tooth assembly (7). The bottom most edge indicated by arrow 8, above the central hub (9) and the completed disk assembly (10).

Provided and visible near the bottom most edge of the front face (2) are apertures passing through the disk section (1) and which locate retaining bolts (14, 15, 16). These retaining bolts secure the disk section (2) to the disk hub (9).

It can also be seen in FIG. 1 that there is a removable portion (18) which accommodates an upward circumferential flange (not visible) on the hub (9). The locating bolts (14-16) pass through corresponding apertures in the flange. A sleeve may optionally be provided about the locating bolts (14-16) in this region.

The illustrated embodiment of a disk section as shown in FIG. 1 also includes additional grinding teeth (20 and 21) extending from the front (2) and rear (3) faces of the disk section respectively.

Figure 2:
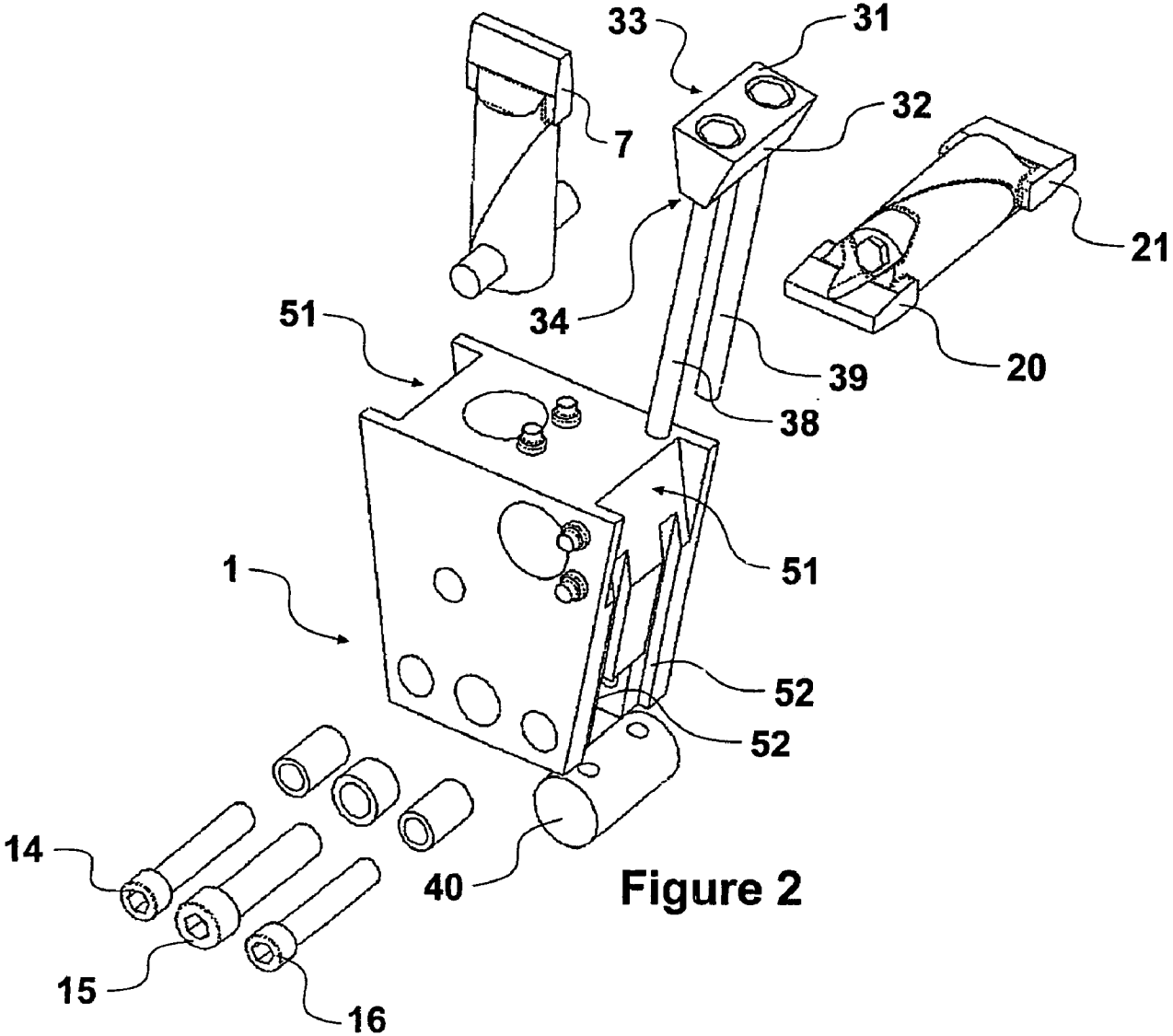
FIG. 2 is a exploded diagrammatic view of the embodiment of FIG. 1.
Figure 3:
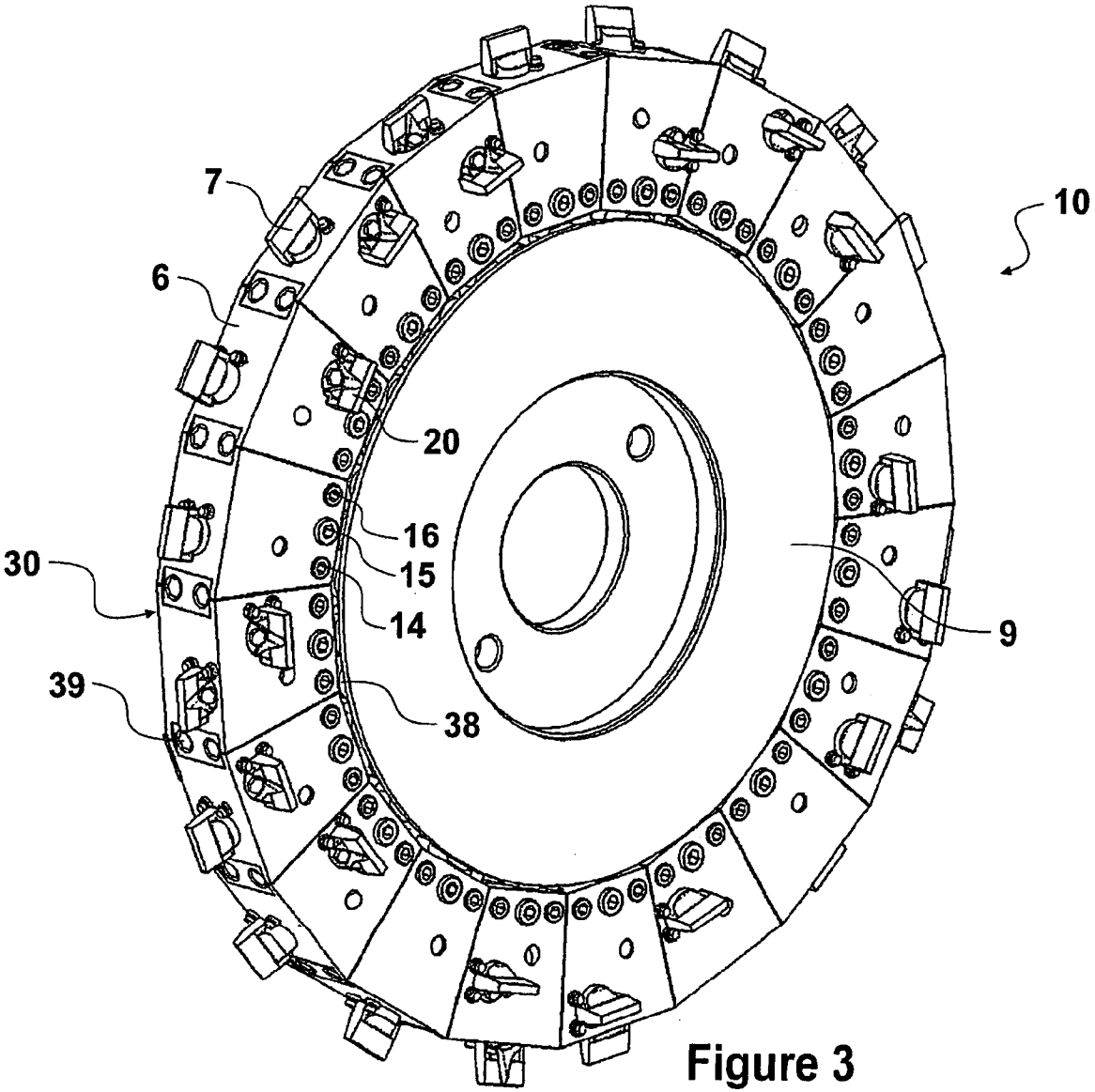
FIG. 3 is a perspective diagrammatic view of a disk assembly made up of sections as per the embodiment of FIG. 1.

Also visible in FIG. 1 is a retaining segment (30) which has a substantially flat top face (31) but tapered side faces (32, 33). The shape of the retaining segment is more clearly illustrated in FIG. 2 where it can be seen that the bottom face (34) is of lesser width than top face (31). The symmetrical nature of the retaining segment (30) is also visible when it is viewed from the front.

Positioned within the retaining segment (30) are apertures (37) for retaining bolts (38, 39) which extend the entire length of the disk section and interact with a mounting pin (40) which is positioned within a suitable aperture in the hub assembly (9). It should be noted that in FIG. 1 the retaining pin (40) is shown in a higher position than it would normally occupy in a disk assembly (10).

These bolts (38, 39) should be high tensile bolts as they will be subjected to significant tensile forces as a result of impact. To a certain extent these bolts may also be considered sacrificial and may need to be replaced during maintenance schedules.

It can also be seen in the disk segment (1) that there is a removed portion (50) for accommodating the retaining segments (30). This removed portion (50) includes an inwardly tapered side wall (51) whose inclination with respect to the sidewall (32, 33) corresponds to the degree of taper on the retaining segment (30). This inclined wall is most clearly seen in FIG. 2.

Also provided are channels (52) for accommodating retaining bolts (38, 39).

Attachment of a disk section (1) to the hub (9) is relatively straight forward. A disk section (1) is positioned approximately in place with its channel (18) fitted over the circumferential flange of the hub (9). The disk section (1) can then be positioned about the circumference of the hub (9) until the apertures for securing bolts (14-16) are aligned with appropriate apertures on the flange. At this point the securing bolts (14-16) may be positioned and loosely tightened. An adjacent disk section (1) can then be put into place and again loosely secured via securing bolts (14-16). At this time the retaining segment (30) and its retaining bolts (38, 39) may also be put loosely into position, but not yet fully tightened. It is also possible that the retaining segments may not be put into place after all the disk sections have been positioned into place.

Once all the disk sections (1) have been put into place the retaining bolts (38, 39) of the retaining segments (30) may be progressively tightened about the disk assembly. As tightening of these bolts has an aligning effect on the disk sections (1), it is desirable not to over tighten any of these bolts as progressive tightening occurs. In some embodiments it may require several passes of each set of retaining bolts of the disk segments for the disk sections to be appropriately positioned. At this stage the securing bolts (14-16) for each section may be fully tightened.

Aspects of the present invention have been described by way of example only and it should be appreciated that modifications and additions may be made thereto without departing from the spirit or scope of the present invention as described herein.

It should also be understood that the term "comprise" where used herein is not to be considered to be used in a limiting sense. Accordingly, 'comprise' does not represent nor define an exclusive set of items, but includes the possibility of other components and items being added to the list.

This specification is also based on the understanding of the inventor regarding the prior art. The prior art description should not be regarded as being authoritative disclosure on the true state of the prior art but rather as referencing considerations brought to the mind and attention of the inventor when developing this invention.

The claims defining the invention are:

1. A disk section of a circular disk assembly, comprising:

a bottom first face for bearing against a supporting hub of a circular disk assembly, said first face being configured to be fitted to the supporting hub;

second and third faces extending from the first face;

a fourth outer face;

a front fifth face, said second and third faces extending from said first face to said fourth outer face, said second and third faces angled with respect to each other such that, when viewed towards the front fifth face, said second and third faces follow radial lines extending outwardly from a center of an assembled circular disk assembly;

a relationship of said second and third faces with said first face being such that with said first face fitted to the supporting hub, said second and third faces follow said outwardly extending radial lines when viewed towards said front fifth face;

a tapered removed portion positioned at each of i) an intersection of said second with fourth faces and ii) an intersection of said third with fourth faces, each tapered removed portion accommodating part of a retaining segment connectable to the supporting hub, an exposed face of each said tapered removed portion being angled away from the second and third faces respectively, and towards said fourth face.

2. A disk section as claimed in claim 1, in which the exposed face of each tapered removed portion is substantially planar.

3. A disk section as claimed in claim 1, in which at least one of said second face and said third face includes additional removed portions to accommodate connection means for the retaining segment to the hub.

4. A disk section as claimed in claim 1, further comprising a grinding tooth, wherein said grinding tooth includes a tip comprising materials selected from the group consisting of a toughened steel, tungsten carbide, diamond, boron nitride, and ceramic materials.

5. A disk section as claimed in claim 1, further comprising:

a grinding tooth comprised of a body and a tooth portion; and an aperture accommodating the body of the grinding tooth.

6. A disk section as claimed in claim 5, further comprising:

an aperture for accommodating a body of a grinding tooth, said aperture positioned to support the grinding tooth to extend from one of i) said fifth front face and ii) an opposing rear sixth face of the disk section.

7. A disk section as claimed in claim 6, wherein the tapered removed sections do not extend fully to the front fifth face and the rear sixth face of the disk section.

8. A disk section as claimed in claim 1, further comprising:

an aperture for accommodating a body of a grinding tooth, said aperture positioned to support the grinding tooth to extend from said fourth face of the disk section.

9. A disk section as claimed in claim 1, wherein the bottom first face of the disk section is slotted to accommodate a circumferential flange of the supporting hub.

10. A disk section as claimed in claim 1, wherein a combined shape and volume of the tapered removed portion of the second face of said disk section, in combination with the tapered removed portion of the third face of said disk section, are the shape and volume of a said retaining segment for use with the disk section.

11. A disk section as claimed in claim 1, wherein the tapered removed portions have angles such that the resulting action when said retaining segment experiences a force towards the hub in said radial direction, when viewed towards said fifth face, a force with a perpendicular, relative to said radial direction, component is exerted against said disk section.

12. A disk section of a circular disk assembly, comprising:

a supporting hub of a circular disk assembly;

a bottom first face bearing against the supporting hub;

second and third faces extending from the first face;

a fourth outer face;

a front fifth face;

a rear sixth face, said second and third faces extending from said first face to said fourth outer face, said second and third faces angled with respect to each other such that, when viewed towards the front fifth face, said second and third faces follow radial lines extending outwardly from a center of an assembled circular disk assembly;

a relationship of said second and third faces with said first face being such that with said first face fitted to the supporting hub, said second and third faces follow said outwardly extending radial lines when viewed towards said front fifth face;

a tapered removed portion positioned at each of i) an intersection of said second with fourth faces and ii) an intersection of said third with fourth faces, each tapered removed portion accommodating part of a retaining segment connectable to the supporting hub, an exposed face of each said tapered removed portion being angled away from the second and third faces respectively, and towards said fourth face; and an aperture for mounting a grinding tooth.

13. A disk section as claimed in claim 12, further comprising:

additional apertures in each of said second face and said third face; and a radial sacrificial retaining bolt accommodated in each of said additional aperatures, each sacrificial retaining bolt connected to said hub.

14. A disk section as claimed in claim 12, further comprising a grinding tooth mounted in said aperture.

15. A disk section as claimed in claim 14, wherein, said grinding tooth comprises a body and a tooth portion, and said aperture accommodates the body of the grinding tooth.

16. A disk section as claimed in claim 15, wherein said aperture supports the grinding tooth to extend from said fourth face of the disk section.

17. A disk section as claimed in claim 15, wherein said aperture supports the grinding tooth to extend from one of i) said fifth front face and ii) an opposing rear sixth face of the disk section.

18. A disk section as claimed in claim 12, further comprising:

a circumferential flange in the supporting hub; and a slot in the bottom first face, the slot accommodating the flange.

19. A disk section as claimed in claim 12, wherein the tapered removed portions have angles such that the resulting action when said retaining segment experiences a force towards the hub in said radial direction, when viewed towards said fifth face, a force with a perpendicular, relative to said radial direction, component is exerted against said disk section.

20. A disk section as claimed in claim 12, further comprising parts allowing re-tightening of the disk section misaligned after an impact, the retightening maintaining rotational balance of the disk assembly.

* * * * *